United States Patent [19]

Stark

[11] 4,331,716

[45] May 25, 1982

[54] SPRAY SHIELDS AND SPRAYING METHODS

[76] Inventor: Bill Stark, 318 E. Foothill Blvd., Arcadia, Calif. 91006

[21] Appl. No.: 98,432

[22] Filed: Nov. 29, 1979

Related U.S. Application Data

[63] Continuation-in-part of Ser. No. 927,179, Jul. 21, 1978, abandoned.

[51] Int. Cl.[3] ..... B05D 1/02

[52] U.S. Cl. ..... 427/282; 118/504; 118/505; 427/284; 427/421

[58] Field of Search ..... 33/415, 416, 421, 481, 33/457, 459, 482; 15/248 R; 51/268, 270, 272, 274, 310; 52/58, 62; 118/504, 505; 427/421, 282, 284, 345

[56] References Cited

U.S. PATENT DOCUMENTS

| | | | |
|---|---|---|---|
| 456,775 | 7/1891 | Prescott | 15/257 R |
| 624,796 | 5/1899 | Hardin | 118/504 |
| 695,965 | 3/1902 | Taylor et al. | 118/504 |
| 1,386,706 | 8/1921 | Hall | 118/504 |
| 1,563,889 | 12/1925 | Zastrow | 118/505 |
| 1,851,497 | 3/1932 | Darling | 118/505 |
| 2,290,472 | 7/1942 | Hendrick | 118/505 |
| 2,332,579 | 10/1943 | Kirby | 91/65 |
| 2,517,220 | 8/1950 | Lister | 118/504 |
| 2,538,743 | 1/1951 | Alston | 118/504 |
| 2,672,122 | 3/1954 | Kupec et al. | 118/504 X |
| 2,842,093 | 7/1958 | O'Neill | 118/504 |
| 2,959,152 | 11/1960 | Byers et al. | 118/505 |
| 3,029,782 | 4/1962 | Eure | 118/505 |
| 3,237,332 | 3/1966 | Petrey | 40/152 |
| 3,380,435 | 4/1968 | Wagner | 118/504 |
| 3,415,675 | 12/1968 | Allen | 427/345 X |
| 3,422,798 | 1/1969 | Pine | 118/504 X |
| 4,023,293 | 5/1977 | Murray | 40/152 |
| 4,085,703 | 4/1978 | Glowacki | 118/504 |

FOREIGN PATENT DOCUMENTS

| | | | |
|---|---|---|---|
| 1400406 | 7/1975 | United Kingdom | 118/504 |

*Primary Examiner*—Shrive P. Beck

*Attorney, Agent, or Firm*—Benoit Law Corporation

[57] ABSTRACT

A spray shield for use at both projecting corners and recessed corners, such as in a spray painting operation, comprises an angled sheet of rigid material having integral first and second legs. The sheet has a first free edge along the first and second legs for hugging a projecting corner. The sheet also has a second free edge along the first and second legs and opposite the first free edge for congruity with or projection into a recessed corner. The sheet is slanted throughout at least one of the legs to extend at an oblique angle two vicinal surfaces of hugged projecting and congruent recessed corners. The integral first and second legs of the spray shield preferably constitute two adjacent sides of a truncated right or oblique pyramid or prism having at least one of its sides extending at an oblique angle to its base.

40 Claims, 11 Drawing Figures

SPRAY SHIELDS AND SPRAYING METHODS

CROSS-REFERENCE

This is a continuation-in-part of U.S. patent application Ser. No. 927,179, filed July 21, 1978 by the subject inventor for Corner Sprayshield, and now abandoned.

BACKGROUND OF THE INVENTION

1. Field of the Invention

The subject invention relates to projection or spray type coating systems, work surface shields, masks or protectors, and painting shields and, more specifically, to spray shields and spraying methods.

2. Disclosure Statement

This disclosure statement is made pursuant to the duty of disclosure imposed by law and formulated in 37 CFR 1.56(a). No representation is hereby made that information thus disclosed in fact constitutes prior art inasmuch as 37 CRF 1.56(a) relies on a materiality concept which depends on uncertain and inevitably subjective elements of substantial likelihood and reasonableness, and inasmuch as a growing attitude appears to require citation of material which might lead to a discovery of pertinent material though not necessarily being of itself pertinent. Also, the following comments contain conclusions and observations which have only been drawn or become apparent after conception of the subject invention or which contrast the subject invention or its merits against the background of developments subsequent in time or priority.

There certainly has been no dearth of proposals in the area of consideration, as may, for instance, be seen from the wall protector disclosed in U.S. Pat. No. 456,775, issued July 28, 1891, the wall protector disclosed in U.S. Pat. No. 624,796, issued May 9, 1899, the wall protecting device disclosed in U.S. Pat. No. 695,965, issued Mar. 25, 1902, the elaborately angled paint guard of U.S. Pat. No. 1,386,706, issued Aug. 9, 1921, the mop board protector of U.S. Pat. No. 1,563,889, issued Dec. 1, 1925, the tool disclosed in U.S. Pat. No. 1,851,497, issued Mar. 29, 1932, the painter's masking shield of U.S. Pat. No. 2,290,472, issued July 21, 1942, the shield for wall moldings of U.S. Pat. No. 2,332,579, issued Oct. 26, 1943, the painting mask of U.S. Pat. No. 2,959,152, issued Nov. 8, 1960, the painters' door shield of U.S. Pat. No. 3,029,782, issued Apr. 17, 1962, the work attached paint shield of U.S. Pat. No. 3,380,435, issued Apr. 30, 1968, the interior decorators' aid disclosed in British patent specification No. 1 400 406, published July 16, 1975, and the paint shielding apparatus of U.S. Pat. No. 4,085,703, issued Apr. 25, 1978.

Despite this seeming wealth of proposals, there persisted a heretofore unsatisfied need for practical and highly efficient spray shields alternatively usable at both projecting corners and recessed corners, methods of spraying projecting corners as well as recessed corners, and methods for selectively spraying corner regions in general.

It is thus believed symptomatic of a backward state of the art that such recent proposal as the shielding apparatus disclosed in the above mentioned U.S. Pat. No. 4,085,703 still employs basically the straight or angled flat cardboard pieces utilized by painters on a makeshift bases for times immemorial.

SUMMARY OF THE INVENTION

It is a general object of this invention to overcome the disadvantages and satisfy the needs expressed or implicit in the above disclosure statement or in other parts hereof.

It is a related object of this invention to provide improved projection or spray type coating systems.

It is a germane object of this invention to provide improved work surface shields, masks and protectors.

It is a related object of this invention to provide improved spray shields, particularly shields usable both at projecting corners and recessed corners.

It is a germane object of this invention to provide improved methods for spraying projecting corners as well as recessed corners.

It is also an object of this invention to provide improved methods and means for spraying corner regions on a selective basis.

Other objects of the invention will become apparent in the further course of this disclosure.

From a first aspect thereof, the subject invention resides in a spray shield for use at both projecting corners and recessed corners, comprising, in combination, an angled sheet of rigid material having integral first and second legs. According to the invention, this sheet has a first free edge along the first and second legs for hugging a projecting corner. Further according to the subject aspect of the invention, this sheet also has a second free edge along the first and second legs and opposite the first free edge for congruity with or projection into a recessed corner. According to a further feature of the subject invention, the sheet is slanted throughout at least one of the first and second legs to extend at an oblique angle to vicinal surfaces of hugged projecting and congruent recessed corners and the sheet extends parallel to a surface of said right-angled corner throughout the other of the legs.

From another aspect thereof, the subject invention resides in a spray shield for use at both projecting and recessed corners, comprising, in combination, integral first and second legs constituting two adjacent sides of a truncated pyramid. These first and second legs have corresponding first free edges for extension along intersecting lines of a projecting corner. The first and second legs also have corresponding second free edges for extension along intersecting lines of a recessed corner.

From a further aspect thereof, the subject invention resides also in a spray shield for use at both projecting and recessed corners, comprising, in combination, integral first and second legs constituting two adjacent sides of a prism, with at least one of the sides extending at an oblique angle to a base of the prism. The first and second legs again have corresponding first free edges for extension along intersecting lines of a projecting corner and corresponding second free edges for extension along intersecting lines of a recessed corner. According to a preferred embodiment of the subject aspect of the invention, the integral first and second leg constitute two adjacent sides of an oblique prism.

From a further aspect thereof, the subject invention resides in a method of spraying projecting corners as well as recessed corners and, more specifically, resides in the improvement comprising, in combination, the steps of providing a one-piece spray shield in the form of an angled sheet of rigid material having integral first and second legs, providing said sheet with a first free edge along the first and second legs for hugging a projecting corner, providing said sheet with a second free edge along the first and second legs and opposite the first free edge for congruity with a recessed corner, slanting said sheet throughout at least one of the legs to extend at an oblique angle to vicinal surfaces of hugged projecting and congruent recessed corners, and positioning said sheet on one of the corners and extending one of the free edges along intersecting lines of the latter corner to set said sheet in place against gravitational pull, thereby preventing said sheet from falling from the latter corner; and spraying the corner while said shield automatically balances itself on the latter corner. From a further aspect thereof, the invention resides in a spray shield assembly set on a projecting corner and, more specifically, resides in the improvement comprising in combination an angled one-piece sheet of rigid material having integral first and second legs and a free edge along the first and second legs extending along intersecting lines of said corner. The sheet is slanted throughout at least one of the legs to extend at an oblique angle to a vicinal surface of the projecting corner, thereby balancing itself automatically on the corner against the pull of gravity during spraying operations.

Other aspects of the subject invention, including methods of selectively spraying corner regions and projecting corners as well as recessed corners, will become apparent in the further course of this disclosure.

BRIEF DESCRIPTION OF THE DRAWINGS

The subject invention and its various aspects and objects will become more readily apparent from the following detailed description of preferred embodiments thereof, illustrated by way of example in the accompanying drawings, in which.

DESCRIPTION OF PREFERRED EMBODIMENTS

The spray shields herein specifically disclosed are primarily intended as an aid in painting and especially in spray painting jobs. A particular utility of these shields resides in their use with airless spraying equipment which typically emits paint at high velocity and narrow angles. However, it should be understood that shields according to the subject invention have utility as work surface shields and similar devices whenever spraying of any substance is to be carried out on a selective basis.

Figure 1:
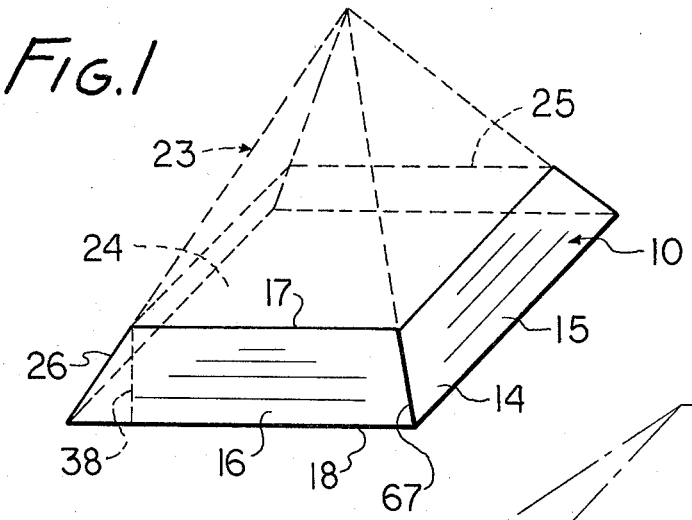
FIG. 1 is a perspective view of a spray shield according to a preferred embodiment of the subject invention, together with an illustration of its principle of formation.
Figure 10:
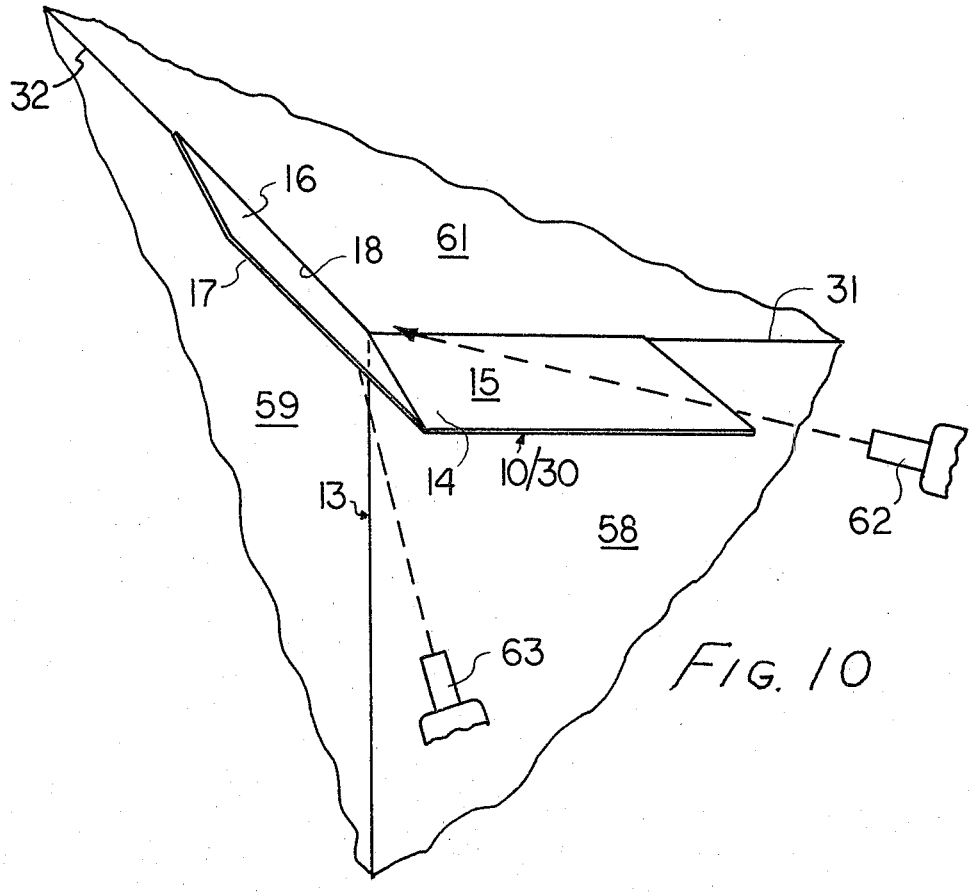
FIG. 10 is a perspective view of a spray shield according to an embodiment of the subject invention, together with an illustration of a recessed corner in which the spray shield may be used.

Most spray shields herein disclosed, including the spray shield 10 shown in FIG. 1, are suitable or specifically intended for use at both projecting corners 12 (see FIG. 11) and recessed corners 13 (see FIG. 10). In such universality of utility, the spray shields according to the preferred embodiments of the subject invention presently under consideration distinguish themselves fundamentally from prior proposals, such as those propounded in the above mentioned British and U.S. patents, including U.S. Pat. No. 1,386,706 and British patent specification No. 1,400,406 where permanent dissection of shield structures would be required to accommodate projecting corners, and a different kind of permanent dissection for an accommodation of recessed corners, as hinted at in FIG. 3 of that British patent specification.

The spray shield 10 shown in FIG. 1, as well as other illustrated spray shields according to preferred embodiments of the subject invention, are formed by or comprised of an angled sheet of rigid material 14 having integral first and second legs 15 and 16 constituting a one-piece shield.

Figure 11:
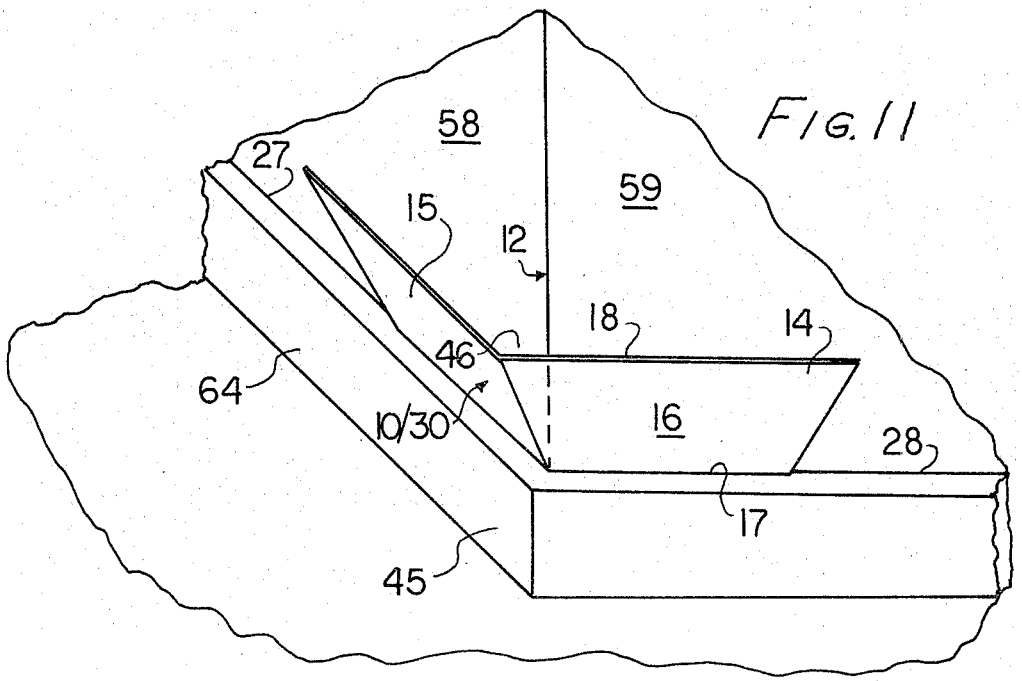
FIG. 11 is a perspective view of the spray shield shown in FIG. 10, together with an illustration of a projecting corner on which this spray shield may be used.

The sheet 14 in particular has a first free edge 17 along the first and second legs 15 and 16 for hugging a projecting corner, such as the corner 12 shown in FIG. 11.

The sheet 14 also has a second free edge 18 along the first and second legs 15 and 16 for congruity with or projection into a recessed corner, such as the corner 13 shown in FIG. 10. As seen in FIG. 1 and elsewhere, the second free edge 18 extends opposite the first free edge 17 along the sheet 14.

According to the subject invention, the sheet 14 is slanted throughout at least one of its legs 15 and 16 to extend at an oblique angle to vicinal surfaces of a hugged projecting corner and of a congruent recessed corner. According to the embodiment illustrated by way of example in FIGS. 1, 2, 5, 10 and 11, the shield 14 is slanted at an oblique angle, as distinguished from a right angle, throughout both of its legs 15 and 16. This distinguishes the shield according to the presently discussed embodiment of the subject invention from such early proposals as the wall protector shown in the above mentioned U.S. Pat. No. 456,775 and such recent proposals as the angled shields shown in certain figures of the above mentioned U.S. Pat. No. 4,085,703. In particular, such prior shields expose wall surfaces to marring and also require that the painter or spray equipment operator interrupt a spraying operation in progress until the wall surface or surfaces which such flat-legged prior shields will significantly contact have dried rather completely.

Also, slant-legged shields according to a preferred embodiment of the subject invention practically eliminate the tendency of prior shields to draw paint from one surface onto and along the other by capillary action.

In brief, shields of the subject invention not only afford a far-reaching universality of utility, but also provide an extensive increase in efficiency for the spray paint operator or other user.

The angled sheet 14 is of rigid material, which requires at least that the spray shield be self-supporting without collapsing under its own weight of gravity. Preferably, the spray shields or angled sheets herein disclosed are made of thin, stiff sheet metal or thermoset plastic of sufficient rigidity to resist undesirable deformation during use. By way of example, 20 gauge sheet metal may be used as material for the sheet 14.

Figure 3:
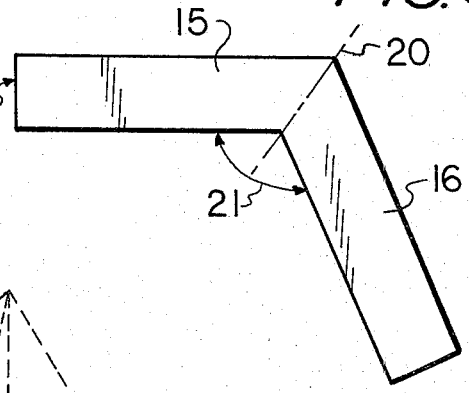
FIG. 3 is a plan view of a blank for making a spray shield according to an embodiment of the subject invention.

As illustrated in FIG. 3, a chevron-shaped blank 19 having the above mentioned first and second legs 15 and 16 may be provided for making a spray shield according to a preferred embodiment of the subject invention. In that case, the spray shield includes a bent chevron-shaped blank 19 having the first and second legs 15 and 16 angled relative to an axis 20 therebetween. The provision of the spray shield then includes the steps of providing a chevron-shaped blank 19 having the mentioned first and second leg 15 and 16 and bending such blank relative to an axis 20 between the first and second legs 15 and 16, until the desired angle, such as the right angle between the legs 15 and 16 shown in FIG. 1, has been accomplished.

Figure 8:
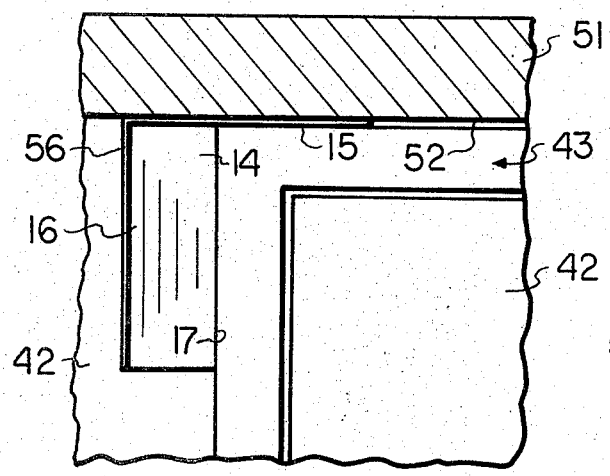
FIG. 8 is an elevation of a spray shield according to another embodiment of the subject invention, together with an illustration of part of a building structure on which the spray shield may be used.
Figure 9:
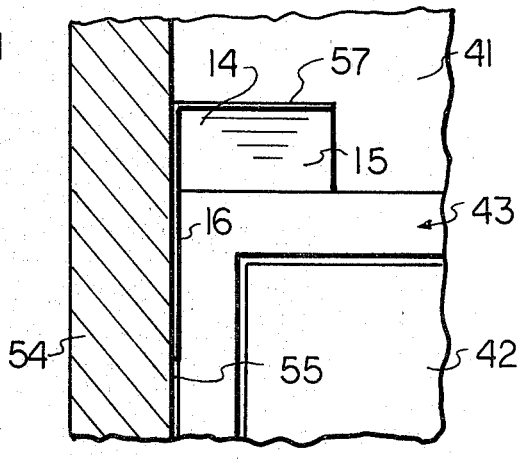
FIG. 9 is an elevation of a spray shield according to another embodiment of the subject invention, together with an illustration of part of a further building structure on which the spray shield may be used.

The size of the initial angle 21 between the legs of the flat blank 19 depends on the slant angle desired for the sides of the completed spray shield. For instance, an angle 21 of about 110° to 120° may be employed for providing a completed spray shield having its sides sloping at an angle of about 45°. On the other hand, the initial angle 21 may be about 140° if one of the sides or legs 15 is to extend at a right angle to the horizontal, as shown in FIGS. 4, 8 and 9, while the other side or leg 16 is to slant at an angle of about 45°.

Figure 2:
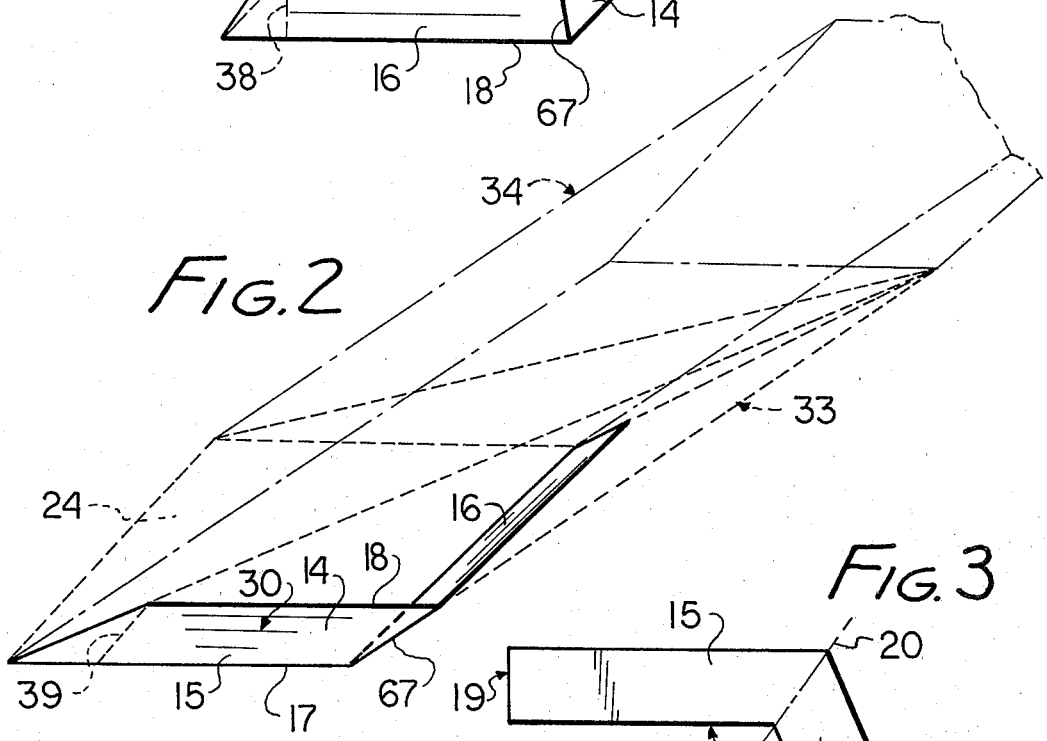
FIG. 2 is a perspective view of a spray shield according to a further preferred embodiment of the subject invention, together with an illustration of its principle of formation.
Figure 4:
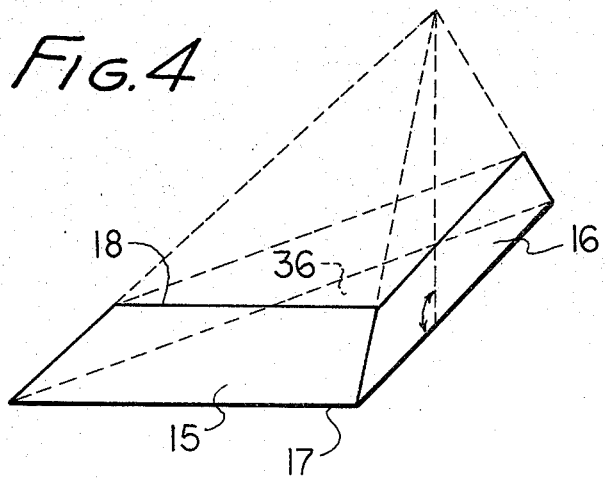
FIG. 4 is a perspective view of a spray shield according to another embodiment of the subject invention, together with an illustration of its principle of formation.

According to embodiments of the subject invention illustrated FIGS. 1, 2 and 4, the integral first and second legs constitute two adjacent sides of a truncated pyramid, with at least one of these sides extending at an oblique angle to a base of the pyramid.

In particular, as shown in FIG. 1, the first and second legs 15 and 16 constitute two adjacent sides of a pyramid 23 which has a base 24 and is truncated by a plane 25. The expression "truncated" as herein employed is intended to be broad enough to cover both pyramidal sections formed by cutting off the vertex of a pyramid at a plane extending obliquely to the base of the pyramid, leaving what may be called a "cornered ungula," and pyramidal frusta, wherein the intersecting plane extends parallel to the pyramidal base.

According to the type of preferred embodiment shown in FIG. 1, the truncated pyramid is a frustum 26.

The first and second legs 15 and 16 have corresponding first free edges 17 for extension along intersecting lines of a projecting corner, such as the lines 27 and 28 of the projecting corner 12 shown in FIG. 11.

The first and second legs 16 and 17 also have corresponding second free edges 18 for extension along intersecting lines of a recessed corner, such as the intersecting lines 31 and 32 of the recessed corner 13 shown in FIG. 10.

In the embodiment of FIG. 1, the corresponding second free edges 18 constitute base edges of the truncated pyramid or frustum 26. The corresponding first free edges 17, on the other hand, extend in an area of truncation 25 of the pyramid 23 extending parallel to the base 24.

As also seen in FIG. 1, the truncated pyramid is a truncated right pyramid 23. On the other hand, and as shown at 33 in FIG. 2, the truncated pyramid may be a truncated oblique pyramid. In that case, a spray shield 30 according to an embodiment of the subject invention is provided in the form of integral first and second legs 15 and 16 constituting two adjacent sides of a truncated oblique pyramid 33, with at least one of these sides being placed at an oblique angle to a base 24 of the pyramid.

In the embodiments particularly illustrated in FIGS. 1 and 2, the sides of the truncated pyramids at the legs 15 and 16 extend in the same sense relative to the pyramid base 24. Thus, in the embodiment of FIG. 1, both sides or legs 15 and 16 are slanted at acute angles relative to the pyramid base 24. On the other hand, in the embodiment of FIG. 2, the sides or legs 15 and 16 are slanted at obtuse angles relative to the base 24. Like acute angles and like obtuse angles may be employed for this purpose for both sides or legs 15 and 16.

It is thus seen that the first leg 15 is composed of a first portion of the sheet 14, while the second leg 16 is composed of a second portion of that sheet 14. According to FIGS. 1 and 2, both of these first and second portions of the sheet 14 are slanted relative to each other. These first and second portions of the sheet 14 in particular form, or are formed as, vicinal first and second sides of a truncated pyramid 23 or 33.

In particular, the latter first and second portions at 15 and 16 of the sheet 14 form vicinal first and second sides of a truncated right pyramid 23.

On the other hand, the first and second portions of the sheet 14 at 15 and 16 form vicinal first and second sides of a truncated oblique pyramid 33 in the embodiment of FIG. 2. In that embodiment, the corresponding first free edges 17 of the sheet 14 along the legs 15 and 16 constitute base edges of the truncated oblique pyramid 33.

Conversely to the case of FIG. 1, the corresponding second free edges 18 may in the embodiment of FIG. 2 extend in an area of truncation of the oblique pyramid 33 extending parallel to the base 24.

Within the broad scope of the subject invention, the integral first and second legs 15 and 16 may also constitute two adjacent sides of a prism, as long as at least one of these sides extends or is made to extend at an oblique angle to a base of the prism. Either the corresponding first free edges 17 or the corresponding second free edges may constitute base edges of the particular prism. In terms of the above mentioned first and second portions of the sheet 14, such first and second portions of the legs 15 and 16 may form, or may be formed as, vicinal first and second sides of a prism.

According to an alternative embodiment of the invention shown in FIG. 2, the prism so far referred to is an oblique prism 34 which may have the same base 24 as the oblique pyramid 33.

Broadly speaking, the base 24 of the pyramid or prism is a polygon, such as a square shown at 24 in FIGS. 1 and 2 or a triangle shown at 36 in FIG. 4.

The triangle 36 preferably is a right triangle so that the integral legs 15 and 16 in FIG. 4, as in FIGS. 1 and 2, extend at right angles to each other, for facilitating use of the spray shields with right-angled corners 12 or 13.

The spray shields according to the subject invention may be provided in different widths and lengths. The extremities of the integral legs 15 and 16 may be slanted as indicated in solid lines in FIGS. 1, and 4, or may be cut square or at right angles as, for instance, indicated by dotted lines 38 and 39 in FIGS. 1 and 2, and as also shown by way of example in FIGS. 5 to 7.

Figure 7:
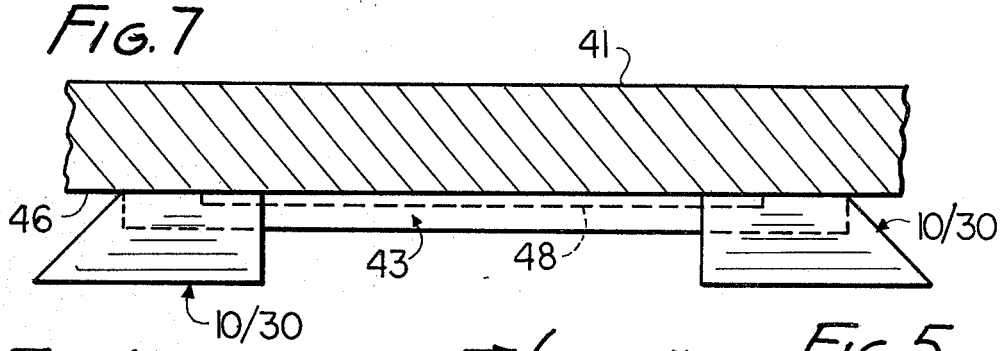
FIG. 7 is a section along the line 7—7 in FIG. 5.
Figure 6:
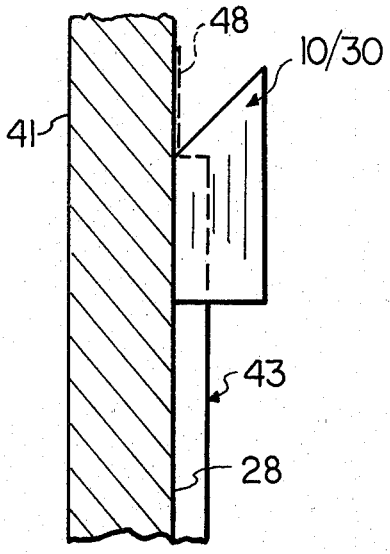
FIG. 6 is a section along the line 6—6 in FIG. 5.
Figure 5:
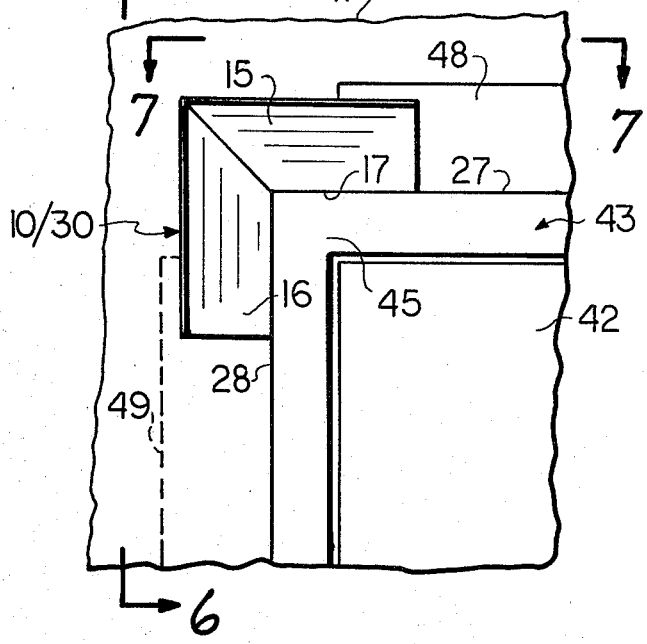
FIG. 5 is an elevation of a spray shield according to a preferred embodiment of the subject invention, together with an illustration of part of a building structure in the spraying of which the illustrated shield may be employed.

FIGS. 5 to 7 show a spray shield 10 or 30 of the type formed according to FIG. 1 or 2, and further illustrate the relationship of such shield to surrounding structure in a typical example of its use.

In particular, FIGS. 5 to 7 show part of a wall 41 having a door or window opening 42 delimited by a frame 43.

In the painting of walls and ceilings, it would be most desirable in terms of efficiency and quality to employ a spray painting process, notably the airless spray painting technique. In practice, the efficiency and quality of such an approach is, however, severely impaired by the lack of suitable spray shields. For instance, the heretofore most practical single straight shield cannot effectively protect the entire plane of a wall area surrounding a right-angled corner of a door or window frame, nor can it shield two planes of a square ceiling or baseboard corner. Therefore, at the state of the art prior to the subject invention, it was practically necessary to brush paint many such corner areas where more than one color or type of coating material came together. This severely detracted from the otherwise great efficiency of paint spray processes.

According to the embodiment of the invention shown in FIGS. 5 to 7, these prior drawbacks are overcome by employing one or more spray shields 10 or 30 at corner regions of the frame 43. The design and construction of these spray shields has been shown in, and described above in connection with, FIGS. 1 to 3. Suffice it to say at this juncture that the method of spraying a first region 45 at a corner provides the first and second legs 15 and 16 with the above mentioned corresponding first free edges 17 for extension along intersecting lines 27 and 28 of the particular corner.

The spray shield 10 or 30 is thus positioned at the corner with the corresponding first free edge 17 extending along such intersecting lines 27 and 28 as, for instance, seen in FIGS. 5 and 11.

The method presently under consideration includes the further steps of spraying the first region 45 at the corner and shielding during such spraying a second region 46 (see FIGS. 7 and 11) at the corner with the positioned spray shield 10 or 30. In other words, the first region 45 is painted while the second region 46 is shielded against paint spray.

The roles of the regions 45 and 46 may and typically are exchanged in practice. For instance, the region 46 shown behind the spray shield in FIGS. 7 and 11 may in effect be the first region which is sprayed, while the region 45 is protected against paint spray by the positioned shield 10 or 30.

Due to the oblique or slanted position of the top leg 15 of the spray shield 10 or 30, with respect to both the horizontal and the vertical, the spray shield according to the subject invention automatically balances itself in that it sets in place against the pull of gravity upon top corners of door frames, window frames, and baseboard structures, requiring no handle or manual support during spraying operations. Thus, while other placements may, if desired, be assisted by the use of a handle (not shown), the spray shields according to the invention as shown in FIGS. 5 to 7 and 11 automatically exploit the pull of gravity so as to prevent their falling down from door frames, window frames or other ledges.

As also shown in FIGS. 5 to 7, the spray shields 10 and 30 may be supplemented by straight cardboard or other shields 48 and 49. These straight shields may, if desired, be held in place by spray shields 10 or 30 according to the subject invention.

A modification within the scope of the subject invention is illustrated in FIGS. 8 and 9, which again show a door or window frame 43 in a wall 41.

According to FIG. 8, a ceiling 51 is that close to the frame 43 that a spray shield of the type of shields 10 and 30 could not be positioned on or at the frame 43. In that case, an embodiment of the subject invention positions one of the legs of the shield, such as the leg 15, in parallel to a surface 52 of the right-angled corner at the frame 43. In other words, the sheet 14 is slanted throughout one of the legs 16 relative to a right-angled corner coinciding with one of the first and second free edges 17 at the first and second legs 15 and 16. On the other hand, the sheet 14 extends or is positioned parallel to a surface of the right-angled corner throughout the other of its legs 15.

FIG. 9 illustrates a case wherein a wall 54 is closely adjacent to a lateral side of the frame 43, so that a slanted leg of the type shown at 16 in FIG. 5 could not be employed. In that case, the sheet 14 may extend or be positioned parallel to a surface 55 of the right-angled corner throughout the lateral leg 16.

The shield 56 and the shield 57 according to embodiments of the subject invention correspond or are interrelated in the manner of right and left-hand gloves. These spray shields 56 and 57 may be formed in the manner shown in FIG. 4, where one of the sides of the truncated pyramid, such as the side at the leg 15, always extends at an oblique angle to the base 36 of the pyramid, and where the other of these sides, such as the side 16, extends at right angles to the base 36. This distinguishes the shields according to FIGS. 4, 8 and 9 from the shields according to FIGS. 1, 2, 5, 6, 7, 10 and 11, wherein the other of the sides at 16 extends at an oblique angle to the base 24 in the same sense as the above mentioned one side at 15. A flat blank of the type of blank 19 may also be employed in making the special shield according to FIGS. 4, 8 and 9. In that case, the initial angle 21 between the legs 15 and 16 has to be dimensioned so that one of the legs will extend at right angles to the base 36 when it is bent about the axis 20 relative to the other leg 15.

Reverting now to FIGS. 10 and 11, it is seen that the sheet 14 is slanted throughout one of its legs 15 relative to a first surface of a right-angled corner 12 or 13 coinciding with one of the first and second free edges 17 and 18 at that one leg. The sheet 14 is further slanted throughout the other of its legs 16 relative to a second surface 59 of the corner 12 or 13 coinciding with the mentioned one of the first and second free edges 17 and 18 of the other leg 16.

In fact, the sheet 14 of the shield 10 or 30 is slanted at the leg 15 with respect to both of two adjacent surfaces 58 and 61, while such sheet 14 is also slanted at the leg 16 with respect to both of two adjacent surfaces 59 and 61 at the corner 13. The same principles apply, of course, to the embodiment shown in FIG. 11.

With the shield 10 or 30 positioned as shown in FIG. 10, the ceiling 61 may be sprayed with an airless spray gun 62, whereby the walls 58 and 59 are protected from the spray of the gun 62. Alternatively or additionally, the walls 58 and 59 nay be painted with an airless spray gun 63, whereby the positioned shield 10 or 30 protects the ceiling 61 from the spray of the gun 63. The same comments apply *mutatis mutandis* to the spraying of the walls 58 and 59 on the one hand and the baseboard 64, on the other hand, in the embodiment of FIG. 11.

The subject invention thus provides a one-piece airless spray painting shield made of thin, stiff metal or plastic, comprised of two planar faces which form a closed right angle at the junction of their free edges 17, and an open right angle (i.e. effectively an angle of 270°) at the junction of their opposite free edges 18. A preferred embodiment forms a 45° angle between each face and (1) the plane 24 defined by the free edges 17, and (2) the plane 24 defined by the free edges 18. The right-angles free edges 17 fit around corners of window frames and door frames 43 and corners 12 of the other structures. The right-angled free edges 18 fit into corners 13 of ceilings and baseboards, thereby providing a corner shield for airless overspray.

In particular, corner spray shields according to the subject invention present a three dimensional right-angled barrier to airless overspray. The junctions of the corresponding free edges 17 and the junctions of the corresponding free edges 18 both present 90° angles; the open right angle formed by the edges 18 fits into three-plane corners, while the closed right angle formed by the edges 17 fits around door frames and window frames. The 45° angle between the top and bottom edges 17 and 18 allows sprayed materials to be directed at both sides. A single placement of said shield enables a skilled airless spray painter to spray corner areas of doors and windows, and any specific plane area or areas of a wall-ceiling, or wall-baseboard junction, while shielding all adjacent areas from overspray, thereby eliminating brushmarks and speeding the coating operation.

A typical corner spray shield within the scope of the subject invention thus is a one-piece tool made of thin, stiff metal or plastic, manufactured for the specific purpose of shielding from overspray, by one positioning of said shield during coating applications of the spray type, areas immediately adjacent to a door, window, baseboard, or ceiling corner at which three planes join together. For a skilled spray painter, all the areas within the protective range of a properly positioned corner spray shield, extending in every direction throughout all planes of areas surroundoung that corner, are shielded from overspray, while all the remaining areas on the opposite side of said shield are sprayed. The "protective range" of a corner spray shield varies with both the dimensions of the shield, and the skill of the spray painter.

The illustrated corner spray shield has two legs or faces 15 and 16 meeting at a linear junction 67 (see FIGS. 1 and 2). Edges 17 of said faces meet to form a closed right angle. Edges 18 of said faces meet to form an open right angle. The angle at the junction of the two faces is 90°. Each face forms an angle of 45° with both the plane 25 defined by the edges 17 and the plane 24 defined by the edges 18 in the embodiment of FIGS. 1 and 2.

Many variations of dimensions and angles are possible which will fulfill the function of a corner spray shield within the scope of the subject invention. Those disclosed above are illustrative of the most useful embodiments presently known to the inventor. Because said design presents both open and closed right angles, both open and closed right-angled corners may be shielded. Because said design presents a 45° angled barrier to overspray, equal shielding from sprayed material on both the front and back sides of both faces is possible by one positioning of said corner shield. The corner areas on either side of said spray shield may be sprayed, while the corner areas on the opposite side of said spray shield are protected from overspray. Because the two faces of said design are symmetrically balanced, hand manipulation for proper placement is simplified. No handle support is necessary for shields placed upon top corners of door frames and window frames.

As indicated above, doors and windows are occasionally so close to walls or ceilings extending perpendicularly that inadequate room exists to accommodate one of the said 45° angled faces of said corner spray shield. To shield such corners, a modification of said corner spray shield must be used. This modification is shown in FIGS. 4, 8 and 9. The modification is comprised of an alteration of the 45° angle between the plane 24 or 25 of the edges 17 or 18 and one of the said faces to a 90° angle, thus changing the angle of the junction between the two faces from 90° to 45°.

The subject extensive disclosure will suggest or render apparent to those skilled in the art various modifications and variations within the spirit and scope of the subject invention and various areas of utility thereof beyond those specifically disclosed herein.

I claim:

1. A spray shield for use at both projecting corners and recessed corners, comprising in combination:
- an angled sheet of rigid material having integral first and second legs;
- said sheet having a first free edge along said first and second legs for hugging a projecting corner;
- said sheet having a second free edge along said first and second legs and opposite said first free edge for congruity with a recessed corner;
- said sheet being slanted throughout at least one of said legs to extend to an oblique angle to vicinal surfaces of hugged projecting and congruent recessed corners; and
- said sheet extending parallel to a surface of said projecting corner throughout the other of said legs.

2. A shield as claimed in claim 1, for shielding a right-angled corner coinciding with one of said first and second free edges at said first and second legs, wherein:
- said sheet is slanted throughout one of said legs relative to said coinciding right-angled corner.

3. A shield as claimed in claim 1, wherein:
- said first leg is composed of a first portion of said sheet;
- said second leg is composed of a second portion of said sheet; and
- said first and second portions of said sheet form vicinal first and second sides of a truncated oblique pyramid.

4. A shield as claimed in claim 1, wherein:
- said first leg is composed of a first portion of said sheet;
- said second leg is composed of a second portion of said sheet; and said first and second portions of said sheet form vicinal first and second sides of an oblique prism.

5. A spray shield for use at both projecting and recessed corners, comprising in combination:

integral first and second legs constituting two adjacent sides of a truncated pyramid, with a least one of said sides extending at an oblique angle to a base of said pyramid and the other of said sides extending at right angles to said base;

said first and second legs having corresponding second free edges for extension along intersecting lines of a recessed corner.

6. A shield as claimed in claim 5 wherein:

said corresponding first free edges constitute base edges of said truncated pyramid.

7. A shield as claimed in claim 6, wherein:

said corresponding second free edges extend in an area of truncation of said pyramid extending parallel to said base.

8. A shield as claimed in claim 5, 6 or 7, wherein:

said truncated pyramid is a truncated oblique pyramid.

9. A shield as claimed in claim 5, wherein:

said corresponding second free edges constitute base edges of said truncated pyramid.

10. A shield as claimed in claim 9, wherein:

said corresponding first free edges extend in an area of truncation of said pyramid extending parallel to said base.

11. A shield as claimed in claim 5, wherein:

said spray shield includes a bent chevron-shaped blank having said first and second legs angled relative to an axis therebetween.

12. A spray shield for use at both projecting and recessed corners, comprising in combination:

integral first and second legs constituting two adjacent sides of a prism, with at least one of said sides extending at an oblique angle to a base of said prism and the other of said sides extending at right angles to said base;

said first and second legs having corresponding first free edges for extension along intersecting lines of a projecting corner; and said first and second legs having corresponding second free edges for extension along intersecting lines of a recessed corner.

13. A shield as claimed in claim 12, wherein:

said corresponding first free edges constitute base edges of said prism.

14. A shield as claimed in claim 12, wherein:

said corresponding second free edges constitute base edges of said prism.

15. A shield as claimed in claim 12, 13 or 14, wherein:

said prism is an oblique prism.

16. A shield as claimed in claim 12, wherein:

said spray shield includes a bent chevron-shaped blank having said first and second legs angled relative to an axis therebetween.

17. In a method of spraying projecting corners as well as recessed corners, the improvement comprising in combination the steps of:

providing a one-piece spray shield in the form of an angled sheet of rigid material having integral first and second legs;

providing said sheet with a first free edge along said first and second legs for hugging a projecting corner;

providing said sheet with a second free edge along said first and second legs and opposite said first free edge for congruity with a recessed corner;

slanting said sheet throughout at least one of said legs to extend at an oblique angle to vicinal surfaces of hugged projecting and congruent recessed corners; and positioning said sheet on one of said corners and extending one of said free edges along intersecting lines of the latter corner to set said sheet in place against gravitational pull, thereby preventing said sheet from falling from the latter corner; and spraying said corner while said shield automatically balances itself on the latter corner.

18. A method as claimed in claim 17, for shielding a right-angled corner coinciding with one of said first and second free edges at said first and second legs, wherein:

said sheet is slanted throughout one of said legs relative to said coinciding right-angled corner.

19. A method as claimed in claim 17, for shielding a right-angled corner coinciding with one of said first and second free edges at said legs, wherein:

said sheet is slanted throughout one of said legs relative to a first surface of said right-angled corner coinciding with said one of said first and second free edges at said one leg; and said sheet is slanted throughout the other of said legs relative to a second surface of said right-angled corner coinciding with said one of said first and second free edges at said other leg.

20. A method as claimed in claim 17, wherein:

said first leg is composed of a first portion of said sheet;

said second leg is composed of a second portion of said sheet; and said first and second portions of said sheet are slanted relative to each other.

21. A method as claimed in claim 17, wherein:

said first leg is composed of a first portion of said sheet;

said second leg is composed of a second portion of said sheet; and said first and second portions of said sheet are formed as vicinal first and second sides of a truncated pyramid.

22. A method as claimed in claim 17, wherein:

said first leg is composed of a first portion of said sheet;

said second leg is composed of a second portion of said sheet; and said first and second portions of said sheet are formed as vicinal first and second sides of a truncated right pyramid.

23. A method as claimed in claim 17, wherein:

said first leg is composed of a first portion of said sheet;

said second leg is composed of a second portion of said sheet; and said first and second portions of said sheet are formed as vicinal first and second sides of a truncated oblique pyramid.

24. A method as claimed in claim 17, wherein:

said first leg is composed of a first portion of said sheet;

said second leg is composed of a second portion of said sheet; and said first and second portions of said sheet are formed as vicinal first and second sides of a prism.

25. A method as claimed in claim 17, wherein:
said first leg is composed of a first portion of said sheet;
said second leg is composed of a second portion of said sheet; and
said first and second portions of said sheet are formed as vicinal first and second sides of an oblique prism.

26. In a method of spraying a first region at a corner capable of supporting a spray shield, the improvement comprising in combination the steps of:
providing a one-piece spray shield in the form of integral first and second legs constituting two adjacent sides of a truncated pyramid, with at least one of said sides being placed at an oblique angle to a base of said pyramid;
providing said first and second legs with corresponding first free edges for extension along intersecting lines of said corner;
positioning said spray shield on said corner with said corresponding first free edges extending along said intersecting lines to set said sheet in place against gravitational pull, thereby preventing said sheet from falling from said corner;
spraying said first region at said corner; and
shielding during said spraying a second region at said corner with said positioned spray shield automatically balancing itself on said corner.

27. A method as claimed in claim 26, wherein:
said corresponding first free edges are arranged as base edges of said truncated pyramid.

28. A method as claimed in claim 27, wherein:
said first and second legs are provided with corresponding second free edges in an area of truncation of said pyramid extending parallel to said base.

29. A method as claimed in claim 26, 27 or 28, wherein:
said truncated pyramid is formed as a truncated oblique pyramid.

30. A method as claimed in claim 26, wherein:
said corresponding first free edges are arranged to extend in an area of truncation of said pyramid extending parallel to said base.

31. A method as claimed in claim 26 or 30, wherein:
said truncated pyramid is a truncated right pyramid.

32. A method as claimed in claim 26, wherein:
the other of said sides extends at an oblique angle to said base in the same sense as said one side.

33. A method as claimed in claim 26 or 32, wherein:
said provision of said spray shield includes providing a chevron-shaped blank having said first and second legs and bending said blank relative to an axis between said first and second legs.

34. In a method of spraying a first region at a corner capable of supporting a spray shield, the improvement comprising in combination the steps of:
providing a one-piece spray shield in the form of integral first and second legs constituting two adjacent sides of a prism, with at least one of said sides being placed at an oblique angle to a base of said prism;
providing said first and second legs with corresponding first free edges for extension along intersecting lines of said corner;
positioning said spray shield on said corner with said corresponding first free edges extending along said intersecting lines to set said sheet in place against gravitational pull, thereby preventing said sheet from falling from said corner;
spraying said first region at said corner; and
shielding during said spraying a second region at said corner with said positioned spray shield automatically balancing itself on said corner.

35. A method as claimed in claim 34, wherein:
said corresponding first free edges are arranged as base edges of said prism.

36. A method as claimed in claim 34, wherein:
said first and second legs are provided with corresponding second free edges in a plane parallel to said base.

37. A method as claimed in claim 34, 35 or 36, wherein:
said prism is formed as an oblique prism.

38. A method as claimed in claim 34, wherein:
the other of said sides extends at an oblique angle to said base in the same sense as said one side.

39. A method as claimed in claim 34 or 38, wherein:
said provision of said spray shield includes providing a chevron-shaped blank having said first and second legs and bending said blank relative to an axis between said first and second legs.

40. In a method of spraying projecting corners as well as recessed corners, the improvement comprising in combination the steps of:
providing a spray shield in the form of an angled sheet of rigid material having integral first and second legs;
providing said sheet with a first free edge along said first and second legs for hugging a projecting corner;
providing said sheet with a second free edge along said first and second legs and opposite said first free edge for congruity with a recessed corner;
slanting said sheet throughout at least one of said legs to extend at an oblique angle to vicinal surfaces of hugged projecting and congruent recessed corners; and
extending said sheet parallel to a surface of said right-angled corner throughout the other of said legs.

* * * * *